US007604396B1

(12) United States Patent
Karterman

(10) Patent No.: US 7,604,396 B1
(45) Date of Patent: Oct. 20, 2009

(54) WRISTWATCH WITH MOVABLE MOVEMENT CASE

(76) Inventor: Don Karterman, 675 Birch St., Anchorage, AK (US) 99501

( * ) Notice: Subject to any disclaimer, the term of this patent is extended or adjusted under 35 U.S.C. 154(b) by 538 days.

(21) Appl. No.: 11/115,836

(22) Filed: Apr. 26, 2005

Related U.S. Application Data

(63) Continuation-in-part of application No. 10/929,695, filed on Aug. 30, 2004, now Pat. No. 7,307,921.

(51) Int. Cl.
*G04B 37/00* (2006.01)
*A44C 5/00* (2006.01)

(52) U.S. Cl. ..... 368/281; 368/276; 368/278; 368/294

(58) Field of Classification Search ..... 368/281, 368/276, 313, 292, 278, 294
See application file for complete search history.

(56) References Cited

U.S. PATENT DOCUMENTS 3,854,278 A * 12/1974 Takeshita et al. ..... 368/239
3,961,472 A * 6/1976 Riehl ..... 368/29
4,006,587 A * 2/1977 Huguenin ..... 368/281
4,015,422 A * 4/1977 Van Haaften ..... 368/281
4,043,116 A * 8/1977 Schlappi ..... 368/296
5,138,590 A * 8/1992 Masuda et al. ..... 368/10
5,262,763 A * 11/1993 Okuyama et al. ..... 345/87
5,757,731 A * 5/1998 Rosenberg ..... 368/242
6,366,538 B1 * 4/2002 Anderson et al. ..... 368/10
6,745,069 B2 * 6/2004 Nissila et al. ..... 600/523
6,940,785 B2 * 9/2005 Ellner et al. ..... 368/88
2005/0052955 A1 * 3/2005 Rochat et al. ..... 368/281
2006/0034161 A1 * 2/2006 Muller ..... 368/281
2006/0126445 A1 * 6/2006 Bouille ..... 368/281

* cited by examiner

*Primary Examiner*—Felix O Figueroa
*Assistant Examiner*—Thanh S Phan.
(74) *Attorney, Agent, or Firm*—Michael J. Tavella

(57) ABSTRACT

A watch design that has a movable of fixed case that keeps the face of the watch visible regardless of the position of the wrist. In this way, a user can quickly see the watch face in the proper orientation so that the time can be quickly and correctly determined. The watch face is offset from the watchcase to provide space for the user's wrist when the face is turned in a viewing position. In this way, a viewer can see the watch face without discomfort caused by the watch face rubbing against the user's wrist. The watch has a display that can be angled for viewing by either forming an angled housing or by using a prism to project the display.

9 Claims, 25 Drawing Sheets

WRISTWATCH WITH MOVABLE MOVEMENT CASE

CROSS REFERENCE TO RELATED APPLICATIONS

This is a continuation-in-part of application Ser. No. 10/929,695, filed Aug. 30, 2004, now U.S. Pat. No. 7,307, 921.

STATEMENT REGARDING FEDERALLY SPONSORED RESEARCH AND DEVELOPMENT

Not Applicable

BACKGROUND OF THE INVENTION

1. Field of the Invention

This invention relates to wristwatches and particularly to wristwatches that have movable movement cases.

2. Description of the Prior Art

Wristwatches have become the standard means of time-keeping for millions of people. They are a convenient way to quickly check the time by simply raising a forearm turning the wrist on which the watch is placed so that one can see the face of the watch. Normally, this takes a couple of seconds and presents no great difficulties.

There are times, however when a user cannot move the wrist so that the face can be seen. These include driving a vehicle, flying a plane, and many other instances in which the hands are not in position so that the watch face can be seen, or, instances in which the hands cannot be easily moved to a viewing position safely.

Some examples of designs that have been developed to allow viewing from different positions include U.S. Pat. No. 3,955,356, which discloses a watch that uses a gravity switch to turn on the face display. In this way, the display is only activated when the user has the watch in the normal viewing position. U.S. Pat. No. 4,006,587 discloses a watch that has a face on the side of the watchcase. This design also incorporates a buckle system mounted on the top of the watchcase. Thus, when this watch is being worn, it is viewed from the side of the wrist. U.S. Pat. No. 4,575,833 teaches a watch that has a formed case that conforms to a user's wrist so that when worn, the face of the watch is on the side of the wrist. In this way, a user does not have to turn the wrist to view the face. U.S. Pat. No. 4,879,702 teaches another watch that is to be worn on the side of the wrist. This patent also shows a design that uses a "U" shaped band on which a watch face is placed. In the latter design, the watch is simple slipped onto the wrist, where it is held in place by friction. U.S. Pat. No. 4,884,256 teaches a device that has a decorative face. This face has formed pieces that form a distinct pattern behind a set of watch hands. U.S. Pat. No. 5,757,731 discloses a watch that has a minimal display that can be repositioned. This allows the watch to have a number of functions besides time keeping. It also allows the display to be positioned on the side of the watch so that it can be seen without turning the wrist.

All of these watches can be used to display the time in different ways. Unfortunately, none of these watches allows a user to view the time while the watch is held in a number of positions in which conventional watch faces cannot be seen.

BRIEF DESCRIPTION OF THE INVENTION

The instant invention overcomes this problem. It is a watch design that has a movable case that keeps the face of the watch visible regardless of the position of the wrist. In this way, a user can quickly see the watch face in the proper orientation so that the time can be quickly and correctly determined.

The means to do that include instances where the adjustment position of the watch face is adjusted by hand; where the readout or the display of the face is changed by electrical switching; or a combination of the above.

One of the embodiments may have either a mechanical display or (light emitting diodes (LEDs) or combination thereof.

The transfer of electrical power from a battery may be by circuit lines or wire or the body case and or the band. Note that on a metal-banded watch can have a removable battery cased in a link. In that case, power is transferred via insulated points of contacts where the links are joined up to the case or body via insulated channels or conduits.

By placing the battery and adjustment (function) switches in the links, there is more area on the main face for the display in the main case and more space to accommodate the case movement mechanism.

There are several ways to accomplish this. First, the case can be mounted on a turntable that rotates on the y-axis. A frame containing the watch mechanism and display is hinged on said turntable. Thus, the display maybe rotated 360 degrees on the lateral y-axis via said turntable and rotated vertically upon the x-axis described by the hinge-mounted frame mounted on said frame. In this way, the display maybe placed in different viewing fields desired by the wearer. Note that the display maybe left flush in the "standard" viewing position where the wearer must raise and rotate there wrist as has always been done with all wristwatches up until now.

Another embodiment uses a gimbal on which the face is free to rotate, much like a compass. Here, however, the watch case is weighted to that the face always moves to a readable position.

The watch may include displays mounted in the link of a watchband. By placing enough displays in the links, the time, or other functions, can be displayed so that the user can see the time in any position.

Finally, the watch can be designed for children by making the watch spring loaded so that it pops up or moves in an amusing manner.

DETAILED DESCRIPTION OF THE INVENTION

There are three basic embodiments and several sub-embodiments of this invention.

First is a design in which the adjustment position of the watch face is adjusted by hand. Second is a design in which the readout or the display/face is changed by electrical switching. The third is a combination of the above, in which one of the embodiments maybe either have a mechanical display or led or combination thereof. Within these main embodiments, there are many ways to accomplish these designs.

Additionally, the transfer of electrical power from a battery may be by circuit lines, wire, the body case, and or the band. (Note that on a metal-banded watch the removable battery can be cased in a link. Power is then transferred via insulated points of contacts where the links are joined, then to the area to be supplied in the case or body via insulated channels or conduits. Further, the adjustment portion of the watch can be housed in the links. Finally, the battery may be embedded in a link on the watchband.

Because, the wrist upon which the watch is banded to is limited to a small surface area, there are limitations as to what can be placed within those confines. However, it is possible to have a comparatively large watch face with a single display mechanical hand or LED that takes up most of the surface area of the face, for either practical or esthetic purpose. Within that display area more then one function can be on display at one time: i.e., a dial for seconds, one for minutes, and one for the hour. A digital watch can have a display large enough to see with out undue strain and still have enough area to place a calculator along with a numerical display. Despite the available surface area on the face, any mechanical apparatus or electrical circuitry along with a battery is stored within the body of the case.

By placing the battery, adjustment and function switches in the links, there is more area on the main face for the display. Moreover, the watch body can have a thinner profile and or more area to place expanded functional electronics therein.

Figure 1:
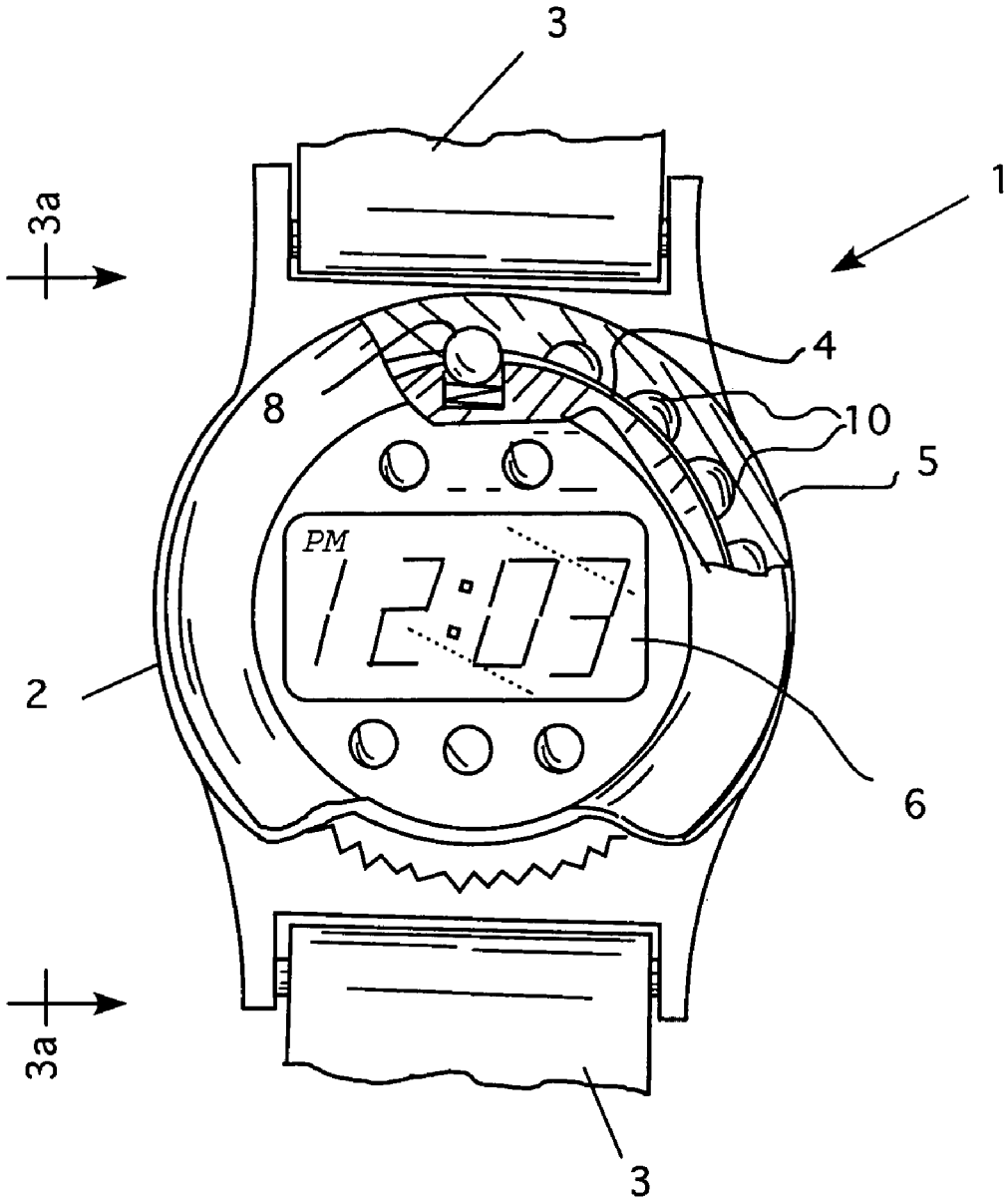
FIG. 1 is a top plan view of a watch face, partially cut-away.
Figure 2:
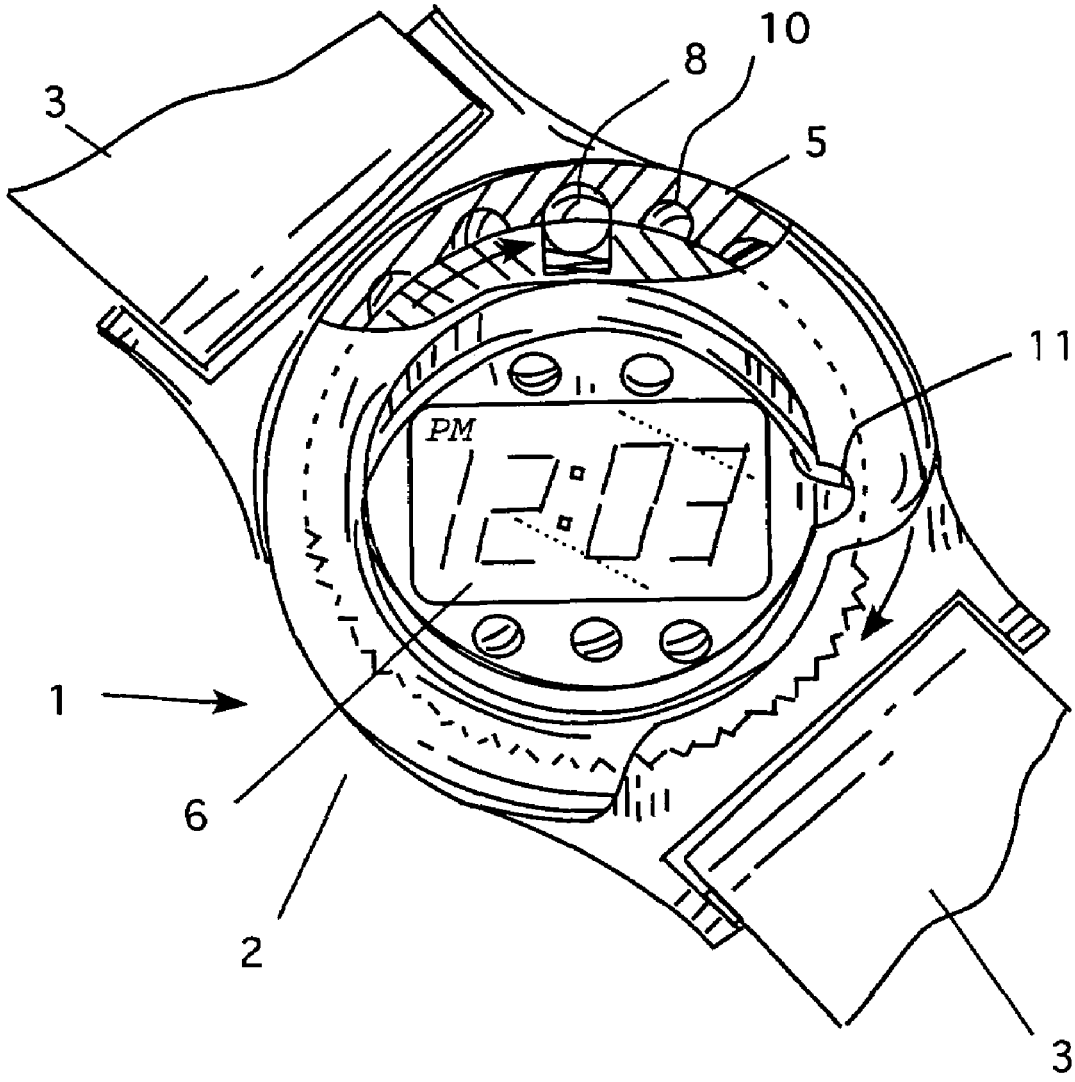
FIG. 2 is a top plan view of the watch face of FIG. 1, partially cutaway, showing the watch face in a rotated position.

Referring now to FIGS. 1-4*b*, the first embodiment of the invention is shown. FIG. 1 shows a main body 2 of the watch 1 to which a band 3 is secured. With in this body 2 a turntable 4 rotates on the y-axis. A frame 5 containing the watch mechanism and display 6 is hingeably attached on the turntable by hinge 7 (see FIG. 3*a*). Thus, the display 6 maybe rotated 360 degrees on the y-axis via said turntable 4. See, e.g., FIG. 2. Moreover, the display can be rotated vertically upon the x-axis by the hinge-mounted frame 5 mounted on said turntable 4. See, e.g., FIGS. 3*b* and 4*b*. In this way, the display 6 maybe placed in different viewing fields desired by the wearer. Note that the display maybe left flush in the "standard" viewing position in which the wearer must raise and rotate there wrist as has always been done with all wristwatches up until now. The ability to rotate and or raise the display, on the other hand, allows a user to position the display in a position to be seen in many other positions.

Figure 3A:
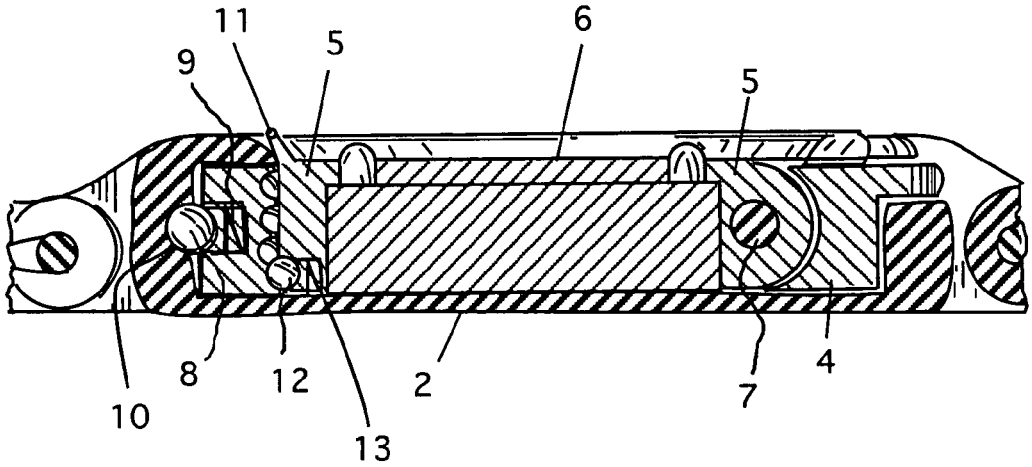
FIG. 3*a* is a side elevation, cross-section of the embodiment of FIG. 1, taken along the lines 3*a*-3*a* of FIG. 1.
Figure 4A:
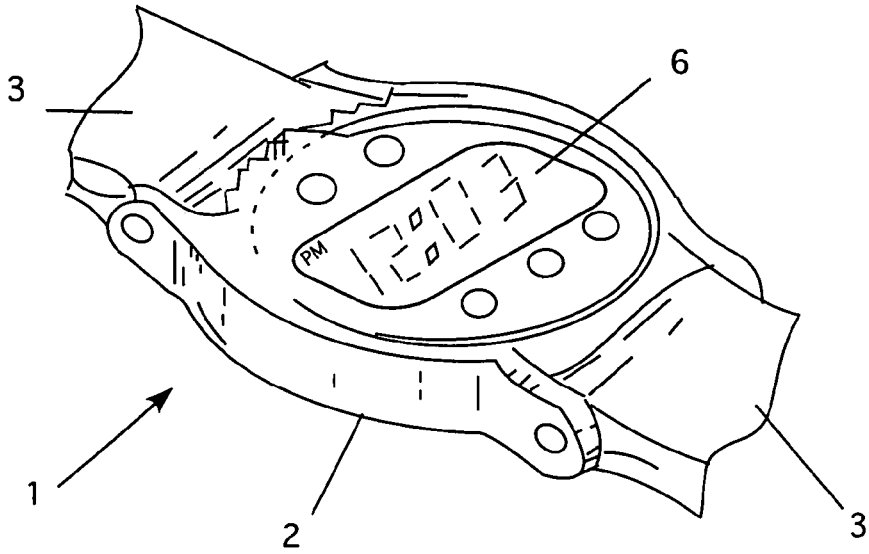
FIG. 4*a* is a perspective view of the watch of FIG. 3*a*.
Figure 3B:
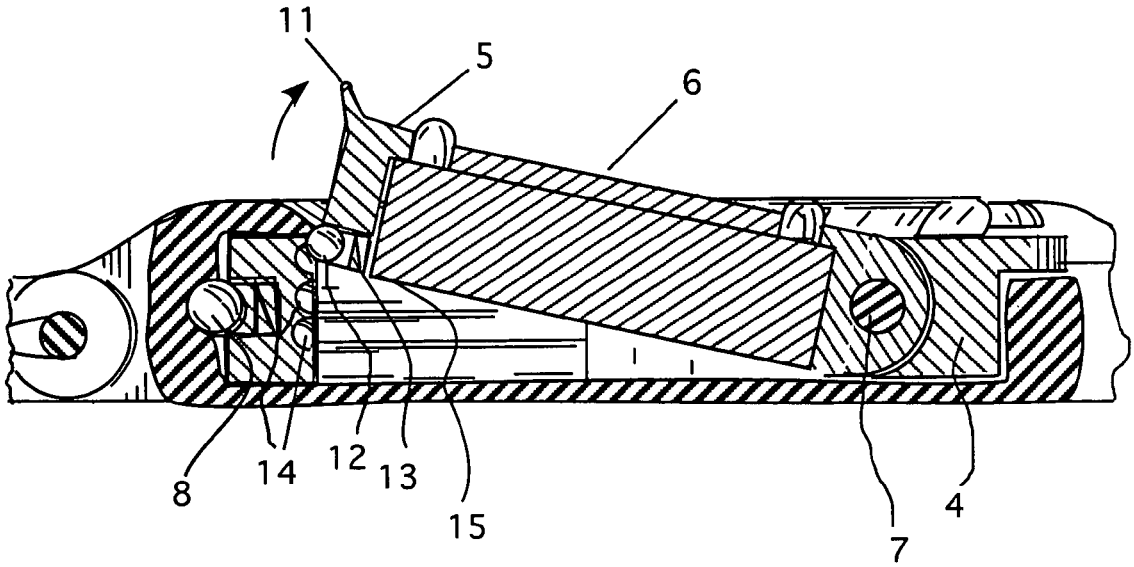
FIG. 3*b* is a side elevation, cross-section of the embodiment of FIG. 1, with the display case elevated.

FIGS. 1, 2, 3*a* and 3*b* show details of the inner workings of this watch. A lock out bearing 8 is attached to the turntable 4 is spring loaded (with spring 9). The bearing 8 engages into reciprocal notches 10 formed in the interior wall of the main body 2. These notches 10 form incremented stops in 360 degrees, which secure the turntable in a desired place, while allowing the face to be easily rotated to a new position. In FIGS. 3*a* and 3*b*, a tang 11 is shown that allows the wearer to grip the rotating display when said display is flush in the case.

Figure 4B:
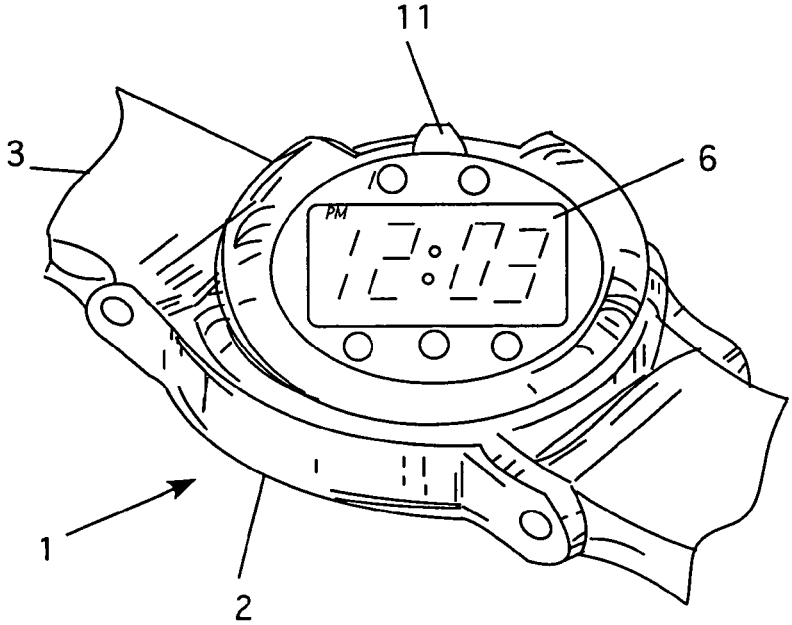
FIG. 4*b* is a perspective view of the watch of FIG. 3*b*, showing the display case elevated.

FIG. 3*b* shows the mechanism for maintaining the display in a vertical position. Here, a spring loaded bearing 12 (with spring 13) is attached to the base 15 of the display frame 5. A series of notches 14 are formed in turntable 4 that receive the bearing 12. This bearing 12 keeps the display in its vertical setting yet allows for the user to press the display and frame back down flush with the case/turntable. Moreover, as shown in FIG. 4*b*, by placing the notches 14 in the turntable 5. The display can be maintained in a vertical position regardless of the rotational position of the face.

Figure 5A:
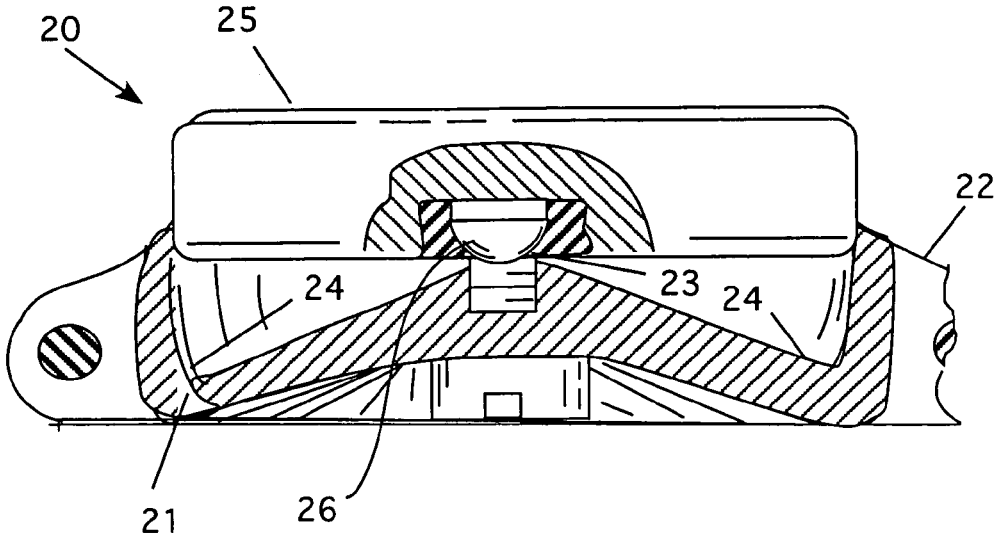
FIG. 5*a* is a cross-sectional view of a second embodiment, in which the display case is mounted on a gimbal.
Figure 5B:
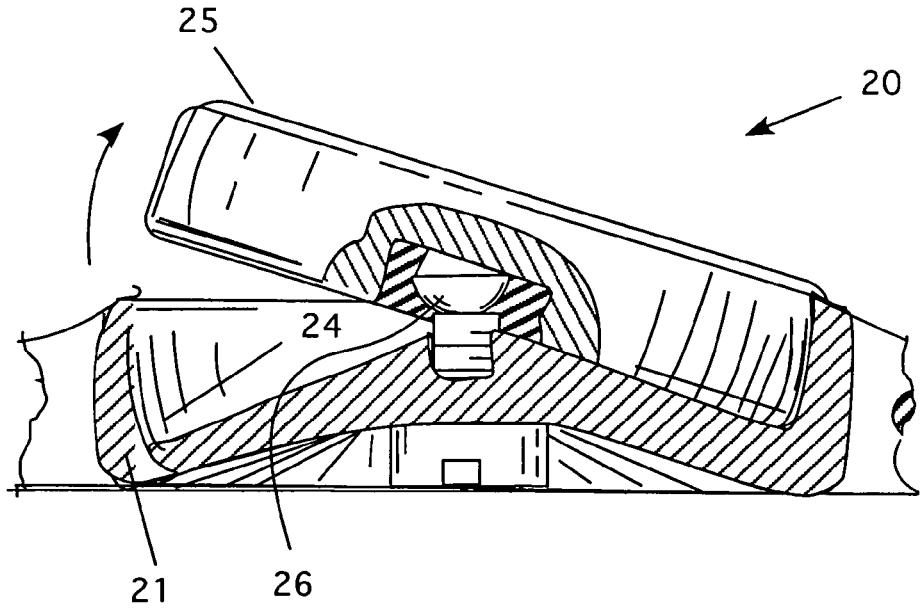
FIG. 5*b* is a cross-sectional view of the second embodiment, in which the display case is mounted on a gimbal, showing the face in a raised position.

FIGS. 5*a* and 5*b* show a second embodiment. In this embodiment, the turntable and hinged frame (with the bearings and notches) have been eliminated. Here, the watch 20 has a base 21 that has a band 22 attached. The base 21 is shaped as shown with a high center point 23 and a sloped bottom 24 that forms a sloping bowl. The display mechanism 25 is attached to the center high point 23 by a gimbaled bearing 26 that allows the display to freely rotate in the y-axis and in the x-axis to the limits of the sloped base (see FIG. 5*b*). The display is weighted so that the display continuously rotates into the position most suitable for viewing in whatever position the user's wrist is in. Thus, it is possible for the user to see the watch display while the user's arm is hanging down vertically by the user's side. Subsequently, the watch face rotates to the proper viewing position-and maintains the proper viewing position as the user's wrist is moved, raised, lowered or turned.

Figure 6A:
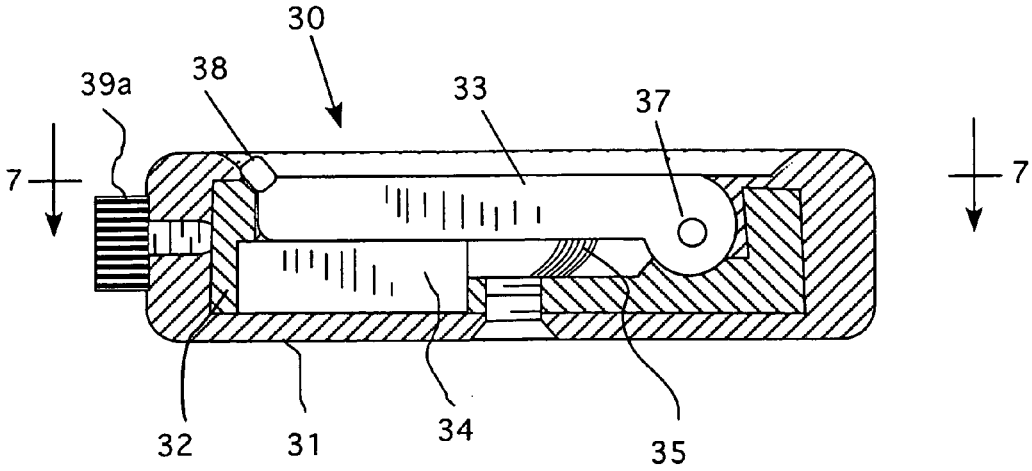
FIG. 6*a* is a cross-sectional view of a third embodiment, in which the display case is manually pivotable.
Figure 6B:
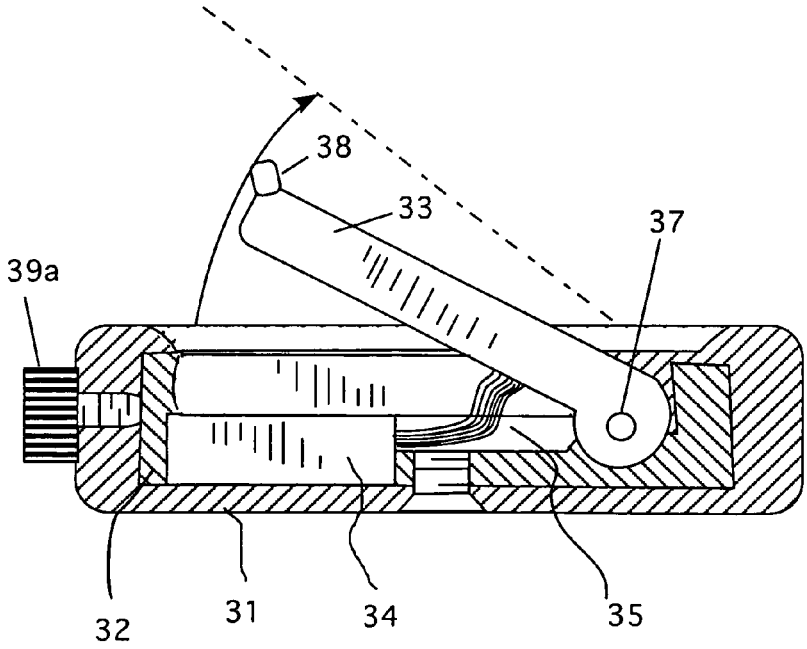
FIG. 6*b* is a cross-sectional view of the third embodiment, in which the display case is, manually pivotable showing the face in a raised position.
Figure 7:
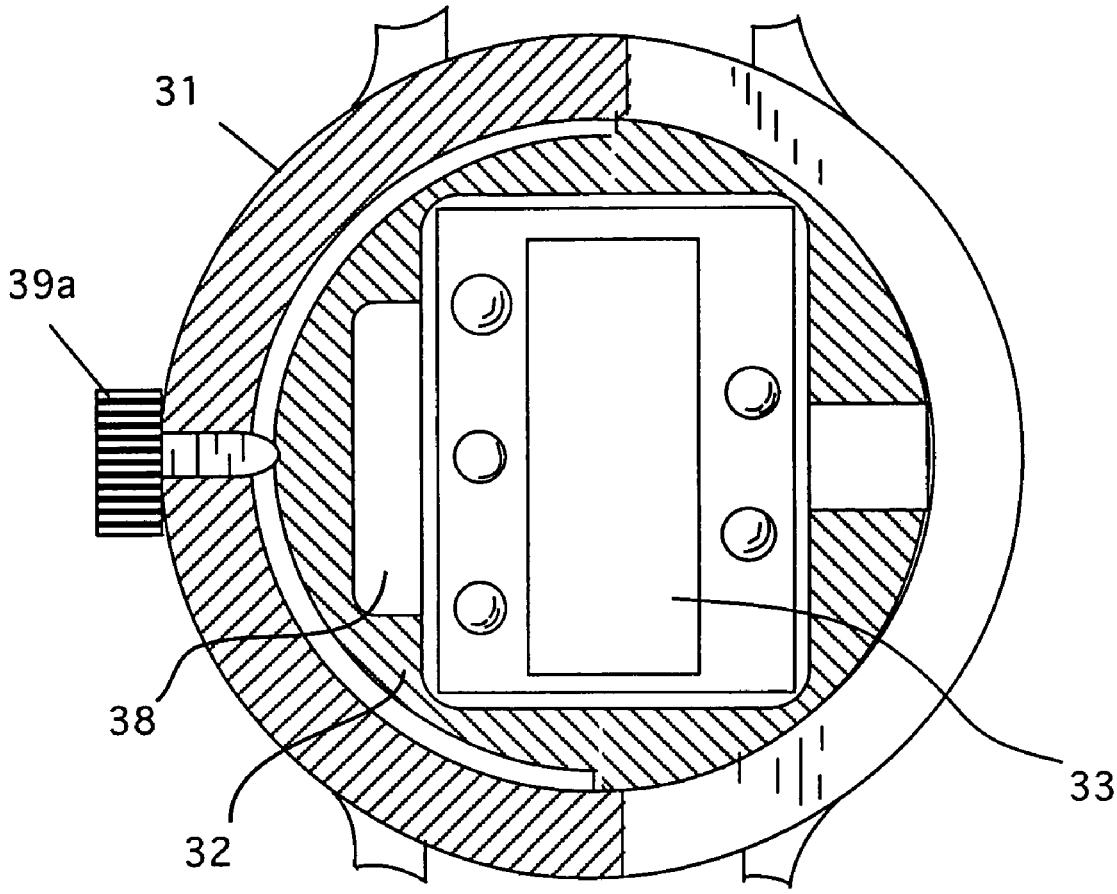
FIG. 7 is a partially cut away top view of the watch of FIG. 6*a* taken along the lines 7-7 of FIG. 6*a*.

FIGS. 6*a*, 6*b* and 7 show yet a different embodiment. In this embodiment, the watch 30 has a case 31 that has an open center that holds a turntable 32 on which sits a watch face 33. A battery 34 sits under the watch face 33. Wires 35 are run from the battery to the face to operate the display 36 (FIG. 7). The watch face 33 is hinged on the turntable with hinge 37. This allows the face 33 to be raised or lowered as desired. A tang 38 allows the user to lift the face to adjust its height. Unlike previous embodiments, which use spring-loaded bearings to position the watch face, this embodiment uses a screw control to hold the watch face in whatever position is desired. Thus, screw 39*a* passes through the case 31 to contact the turntable 32. To turn the watch face in the y-axis, the user loosens the screw 39*a*, and then turns the turntable to the desired position. The screw 39*a* is then tightened against the turntable to hold it in place. The tilted watch face can be held in the vertical position using detent bearings, friction, or other means, as discussed above FIG. 8 shows an embodiment that can be used with any of the previous embodiments to further enhance the operation of the watch. In this embodiment, the watchband 40 is made up of a series of metal links 42. A number of the links have a display 41 that display the time, or other information. The links are connected by a series of connectors 43 that act as electrical conduits. Thus, a user can see the time, for example, in whatever position the user's wrist is in at any given time. This allows a user to keep up on the time without having to move the wrist to see the main watch face.

Figure 8:
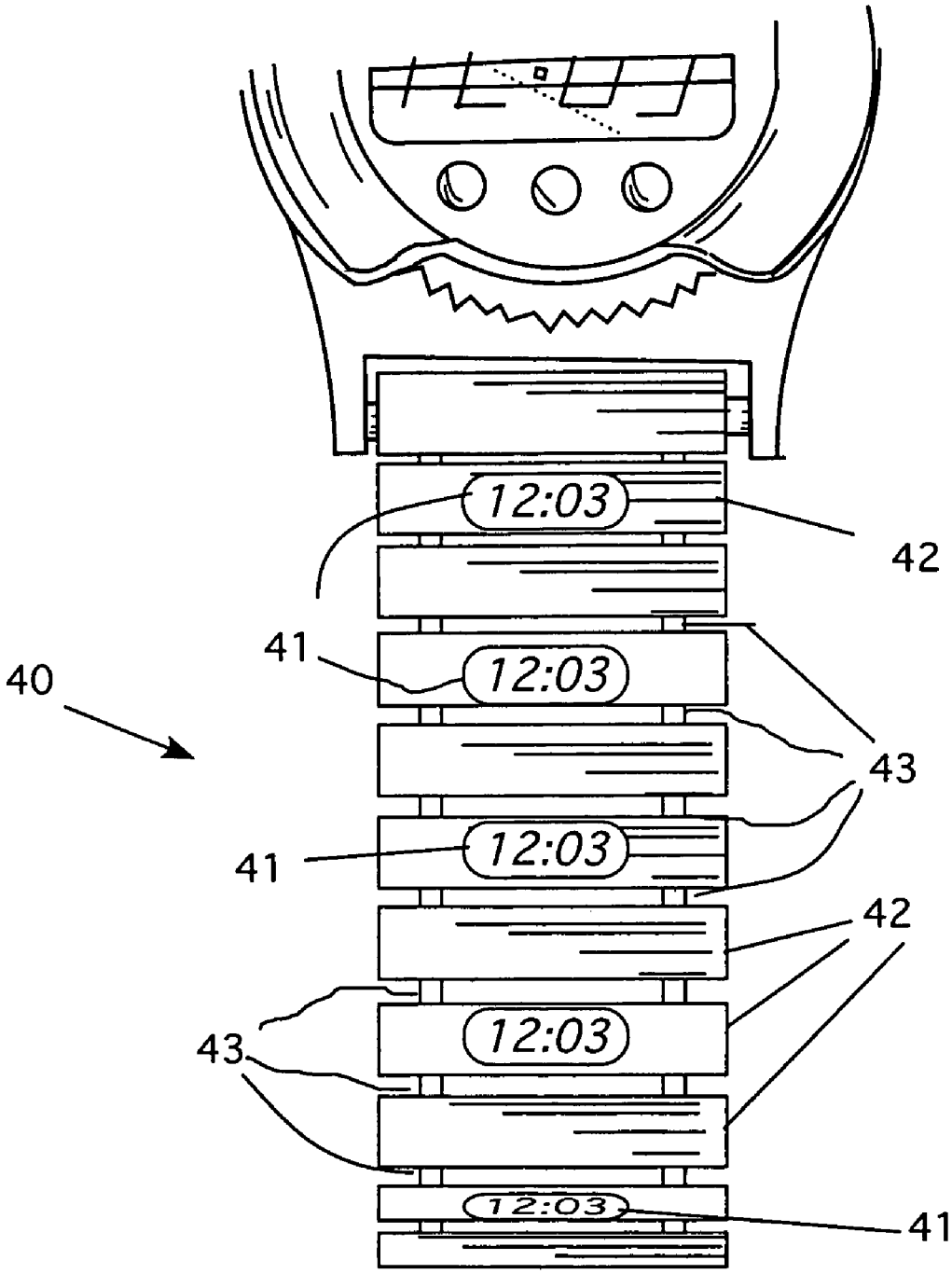
FIG. 8 is a top view of a fourth embodiment, showing displays mounted in links on a watchband.
Figure 8A:
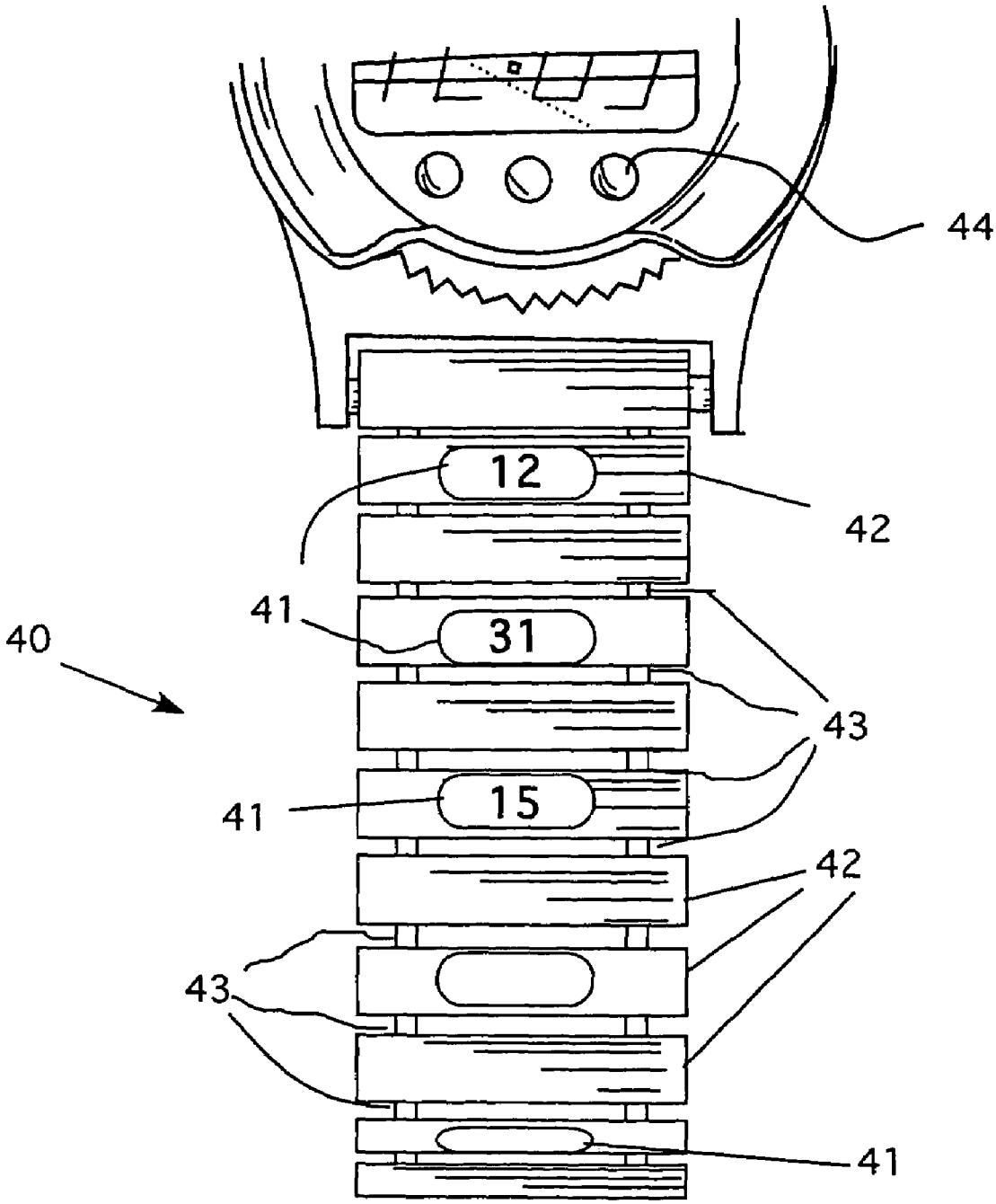
FIG. 8*a* is a variation of the fourth embodiment.

FIG. 8*a* is a variation on the embodiment of FIG. 8. Here, the watchband 40 is made up of a series of metal links 42 as before. These links have displays 41 that display the time, or other information. Unlike the watch of FIG. 8, however, this embodiment displays the information on separate links. As shown, the time, "12:31:15" is displayed on three links as "12", "31", and "15" as separate numbers. As before, the links are connected by a series of connectors 43 that act as electrical conduits. Unlike the design of FIG. 8, this version does not display the time on all of the displays on the links. Notice that the displays 41 on the lower portion of the band are not displaying any numbers. A button 44 on the watch is used to cause the displays to activate circumferentially around the watch bank. Thus, the time can be displayed in any desired position by simply moving it to the desired position by pressing the button 44.

Figure 9:
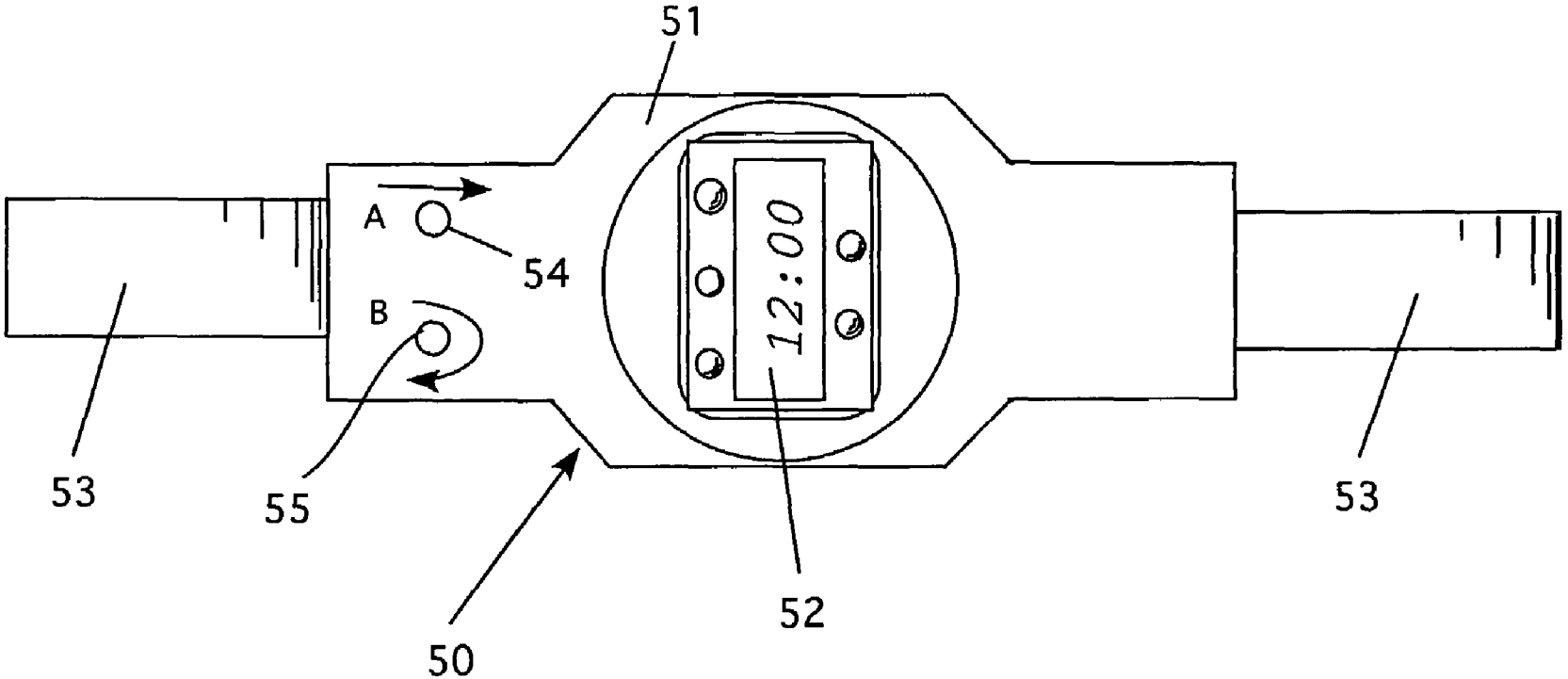
FIG. 9 is a top view of a fifth embodiment of the invention.
Figure 10:
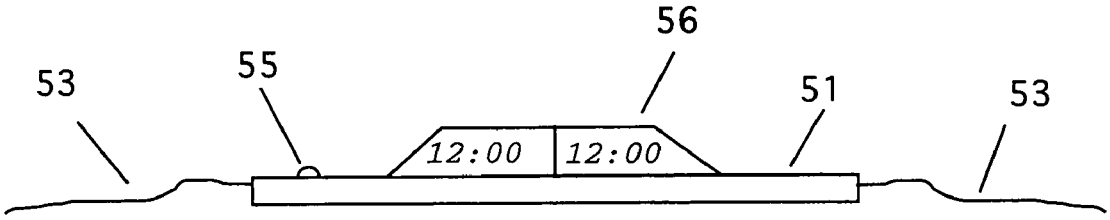
FIG. 10 is a side view of the fifth embodiment.

FIGS. 9 and 10 show a fifth embodiment of the invention. Here, the watch 50 is shown is a top view in FIG. 9. The watch has a case 51 with a display 52 and a band 53. FIG. 10 shows that the display 52 extends above the case. The extra height accommodates a side display 56 as shown. Two buttons are placed on the case 51 as shown. Button "A" 54 is used to turn on the display on the face of the watch as shown in FIG. 9. Button "B" 55 is used to shift the display from the face to the side display. In this way, a user can quickly change the display as desired for the most convenient way to see the display.

Figure 11:
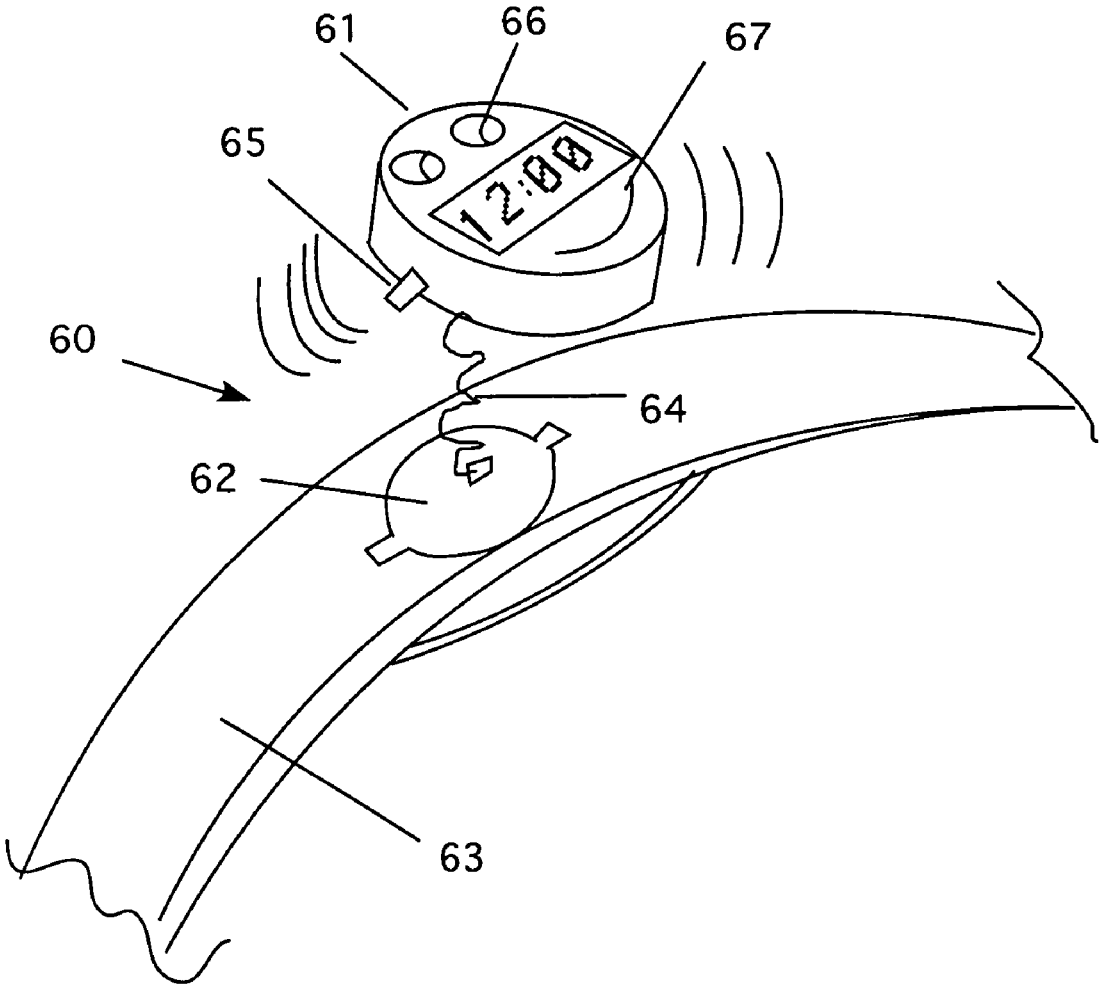
FIG. 11 is a perspective view of a sixth embodiment of the invention.

FIG. 11 shows a sixth embodiment of the invention. Here, the watch 60 is a timepiece for children. It has a spring-loaded display 61 mounted in a receptacle 62 in a band 63. A spring 64 is mounted in the receptacle, which is also attached to the display. A button 65 is used to release the watch from the receptacle 62. When the watch is released, the spring causes the watch to pop up in an amusing manner. To make the watch more interesting for children, the face can be decorated with a design, such a pair of eyes 66 and a mouth 67. Of course, other designs may be used as well. As an alternative, the spring 64 can be a flexible member that acts like a gooseneck to hold the watch in a firm, but adjustable position. Moreover, the member 64 can be rigid to hold the watch face in an extended fixed position, if desired.

Figure 11A:
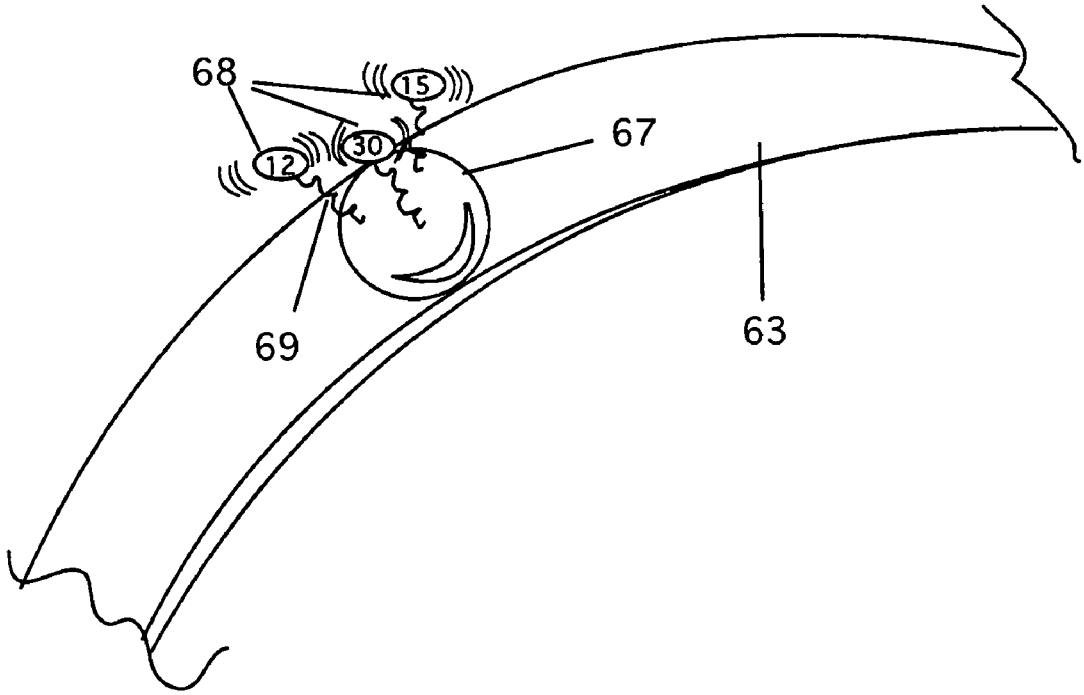
FIG. 11*a* is a perspective view of a variation of this sixth embodiment.

FIG. 11*a* is a variation of this sixth embodiment. In this embodiment, the face 67 is attached to the band 63. Three miniature displays 68 are attached to the face 67 with springs 69, which, as before, can be flexible like a spring, bendable like a gooseneck, or even rigid, if desired.

Figure 12:
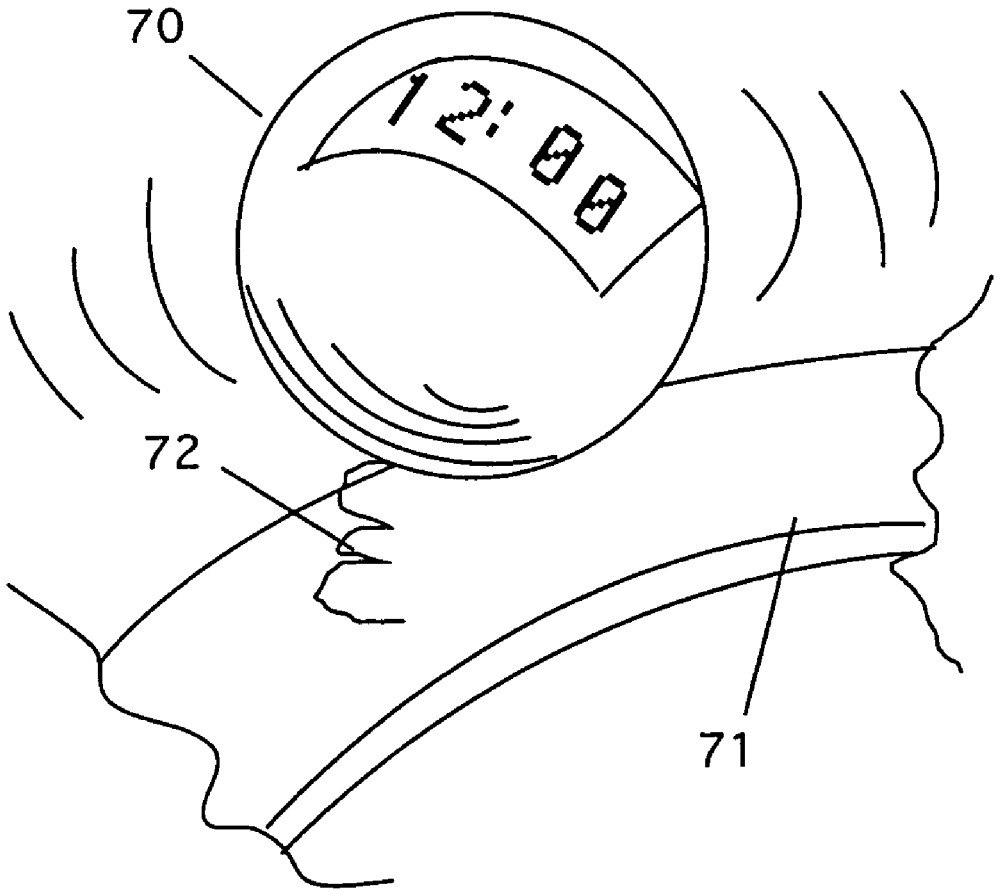
FIG. 12 is perspective view of a seventh embodiment.

FIG. 12 is another embodiment of the child's watch. Here, the watch body 70 is a sphere. The display is positioned as shown on the surface. The sphere 70 is attached to a band 71 by a spring 72. This allows the watch to move in an amusing manner. As above, the spring 72 can be a gooseneck member or rigid, if desired.

Figure 13:
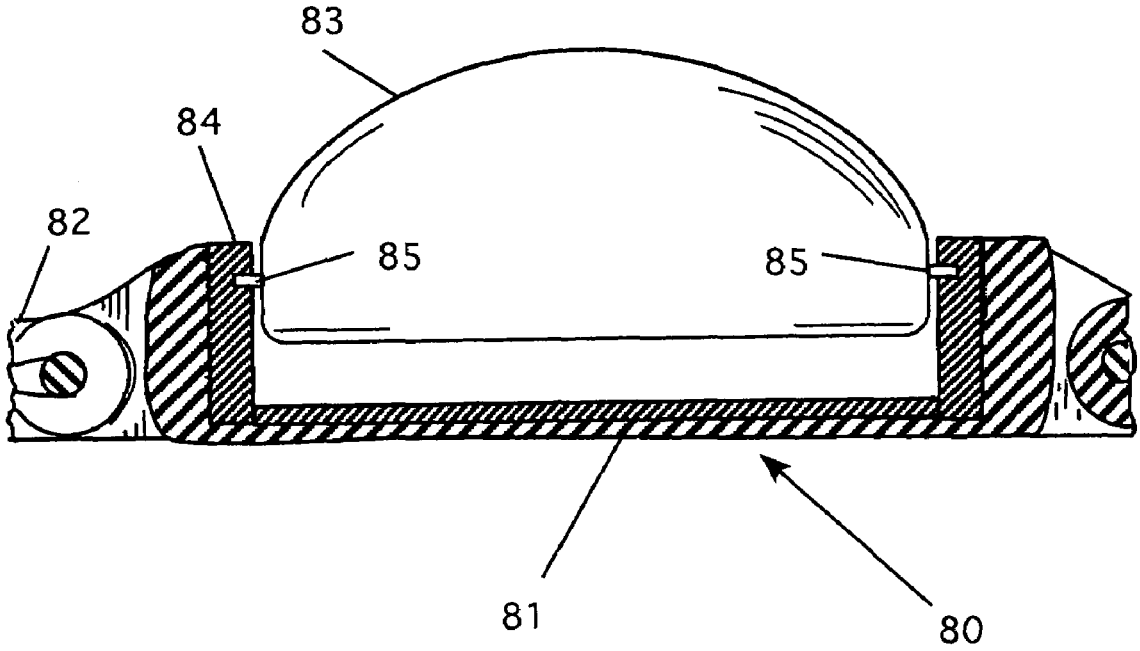
FIG. 13 is a cross-sectional view of an eighth embodiment.

FIG. 13 is a cross-sectional view of an eighth embodiment. In this embodiment, the watch 80 has a base 81 that has a band 82 attached. He inside of the case is hollow to accept a turntable 83. A curved, semispherical display 83 is mounted inside the turntable 84 and is held by pins 85, which act as axels for the display. The pins 85 allow the display to pivot on the axels. In this way, the display can be rotated over 360 degrees and can tilt forward or back as the user desires. Stops can be used to limit the travel of the display, as well as to hold it at a desired tilt. Similarly, stops may be used, as discussed above, to control the position of the turntable 84 within the case 81.

Figure 14:
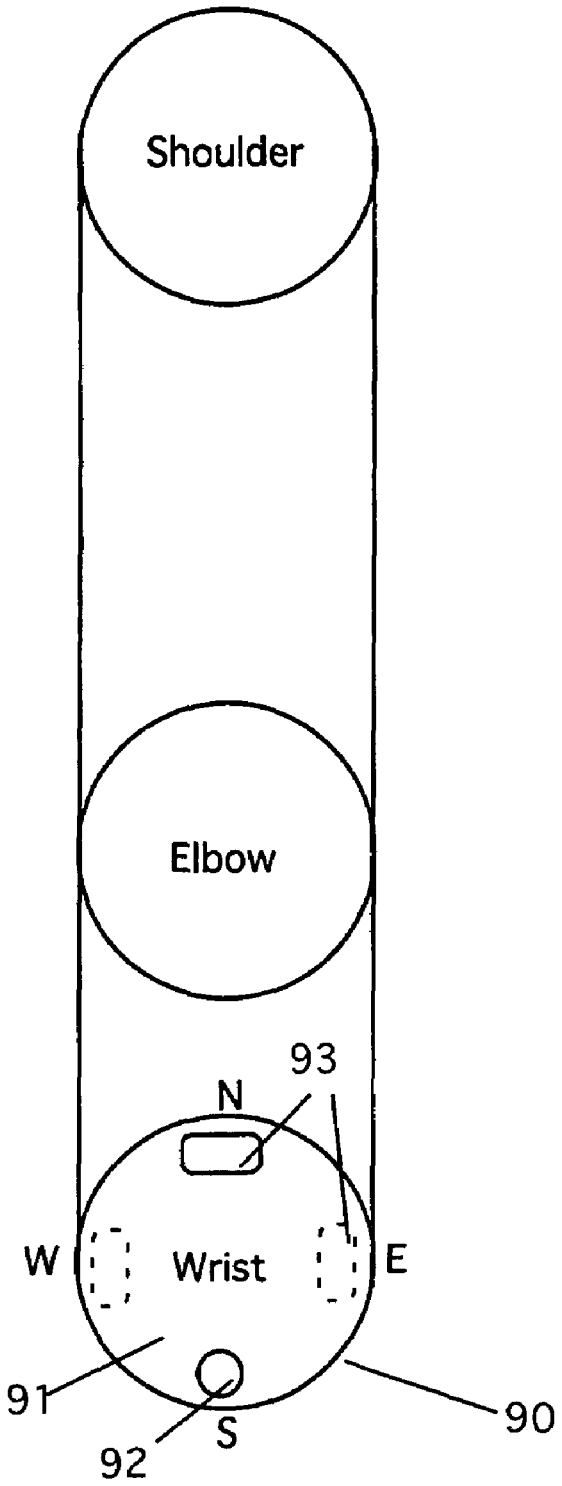
FIG. 14 is a schematic diagram showing the operation of a ninth embodiment, in a first position.

FIG. 14 is a schematic diagram showing the operation of a ninth embodiment, in a first position. In this embodiment, the watch 90 is shown in place on a schematic 18 wrist 91. The watch has a rotating bearing switch 92 and four displays 93 positioned around the face. Note, here, only the "North" display is shown. See below for the additional displays. As shown in the figure, with the user's arm held straight down, the bearing switch is in the "south" position and the display is on in the "north" position.

Figure 15:
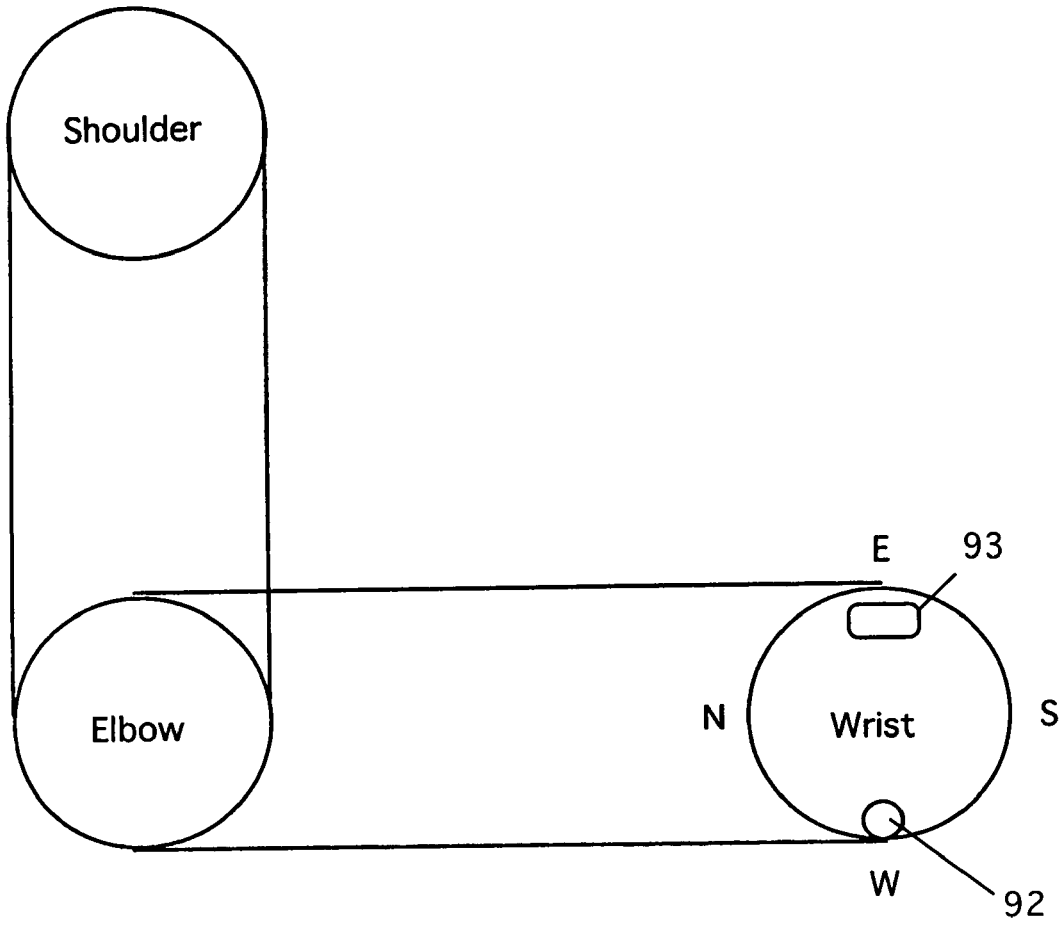
FIG. 15 is a schematic diagram showing the operation of the ninth embodiment in a second position.

FIG. 15 shows the watch and the user's arm rotated to a perpendicular position. Here, the bearing switch 92 has rotated to the "west" position. In this position, the "north" display is deactivated and the "east" display is turned on.

Figure 16:
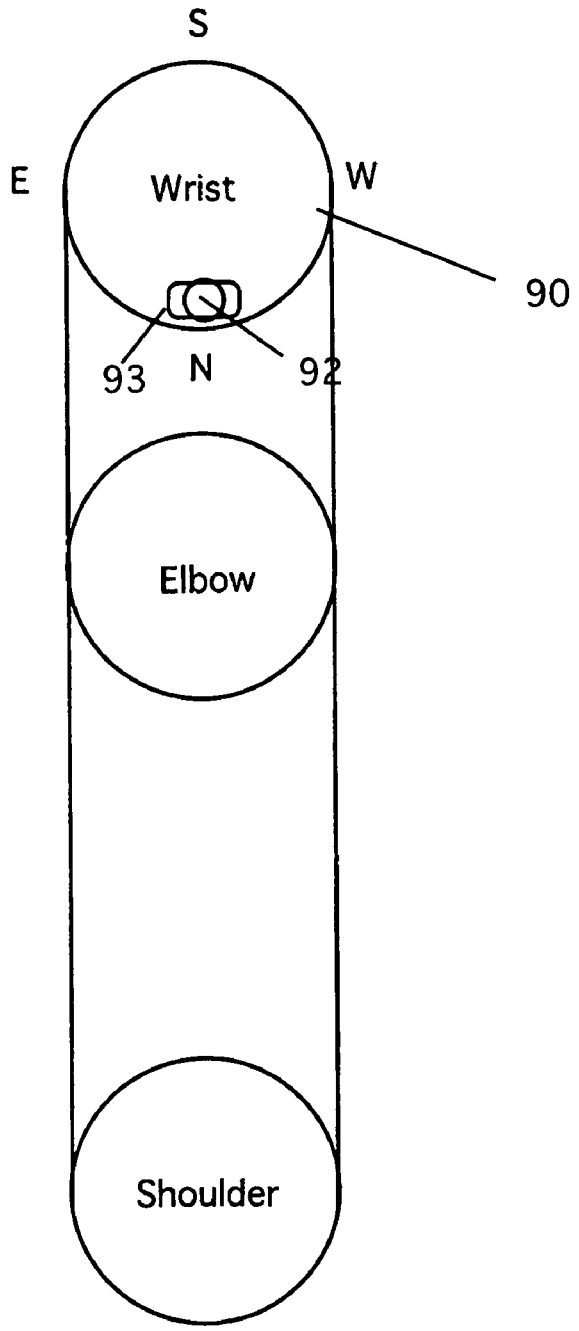
FIG. 16 is a schematic diagram showing the operation of the ninth embodiment in a third position.

FIG. 16 shows the watch 90 in yet a third position. Here, the user's hand is above the user's head. In this position, the bearing switch has rotated to the "north" position and it has activated the "north" display. The system has an instruction that when the bearing switch is in this position, the display 93 is activated in a reversed orientation so that it is readable (instead of being upside down).

Figure 17:
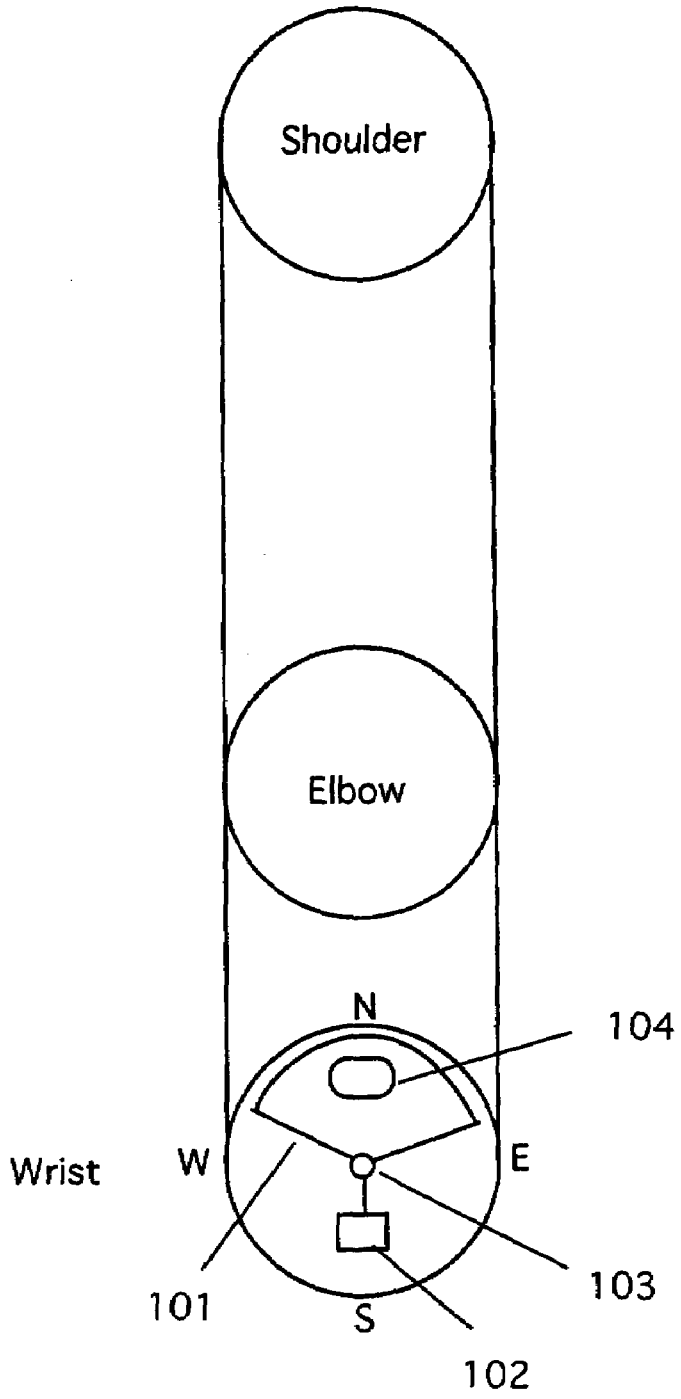
FIG. 17 is a schematic diagram showing the operation of a tenth embodiment, in a first position.
Figure 18:
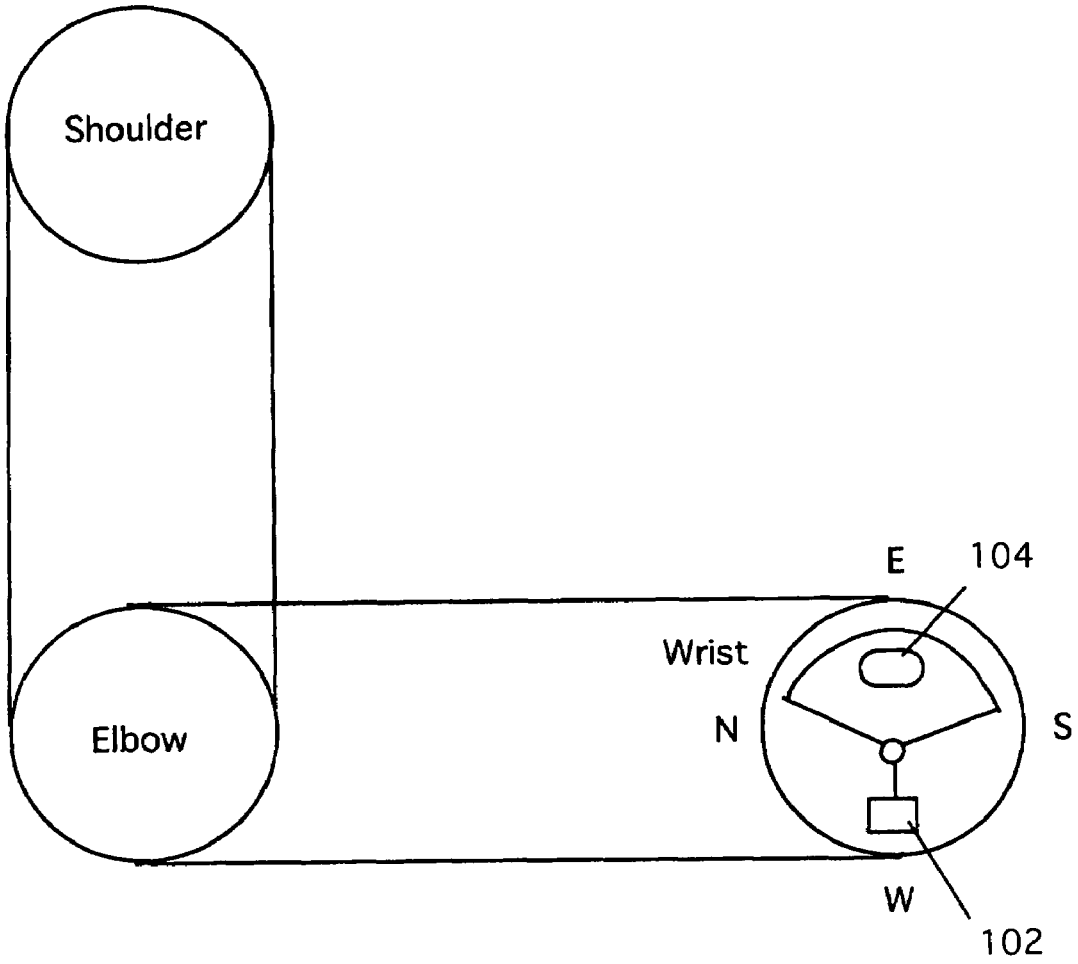
FIG. 18 is a schematic diagram showing the operation of the tenth embodiment in a second position.

FIGS. 17 and 18 show a variation of this embodiment. Here, the bearing switch is replaced by a pendulum switch 101 that has a weight 102 attached as shown. The pendulum switch 101 is mounted to a pivot 103. As in the embodiment above, the position of the pendulum switch 101 determines which of the displays is activated. As before, with the user's arm held straight down (FIG. 17), the weight 102 is in the "south" position and the display 104 is on in the "north" position.

FIG. 18 shows the watch and the user's arm rotated to a perpendicular position. Here, the pendulum switch weight 102 has rotated to the "west" position. In this position, the "north" display 104 is deactivated and the "east" display is turned on.

Note that this embodiment has a stop (not shown) that is designed to limit the travel of the pendulum switch 101. Because the pendulum relies on a weight, if the watch was turned upside down (as in FIG. 16), the pendulum switch 101 would return to the original vertical position and the display (on at the "north") would not be visible. To prevent this, the stop is used.

Figure 19:
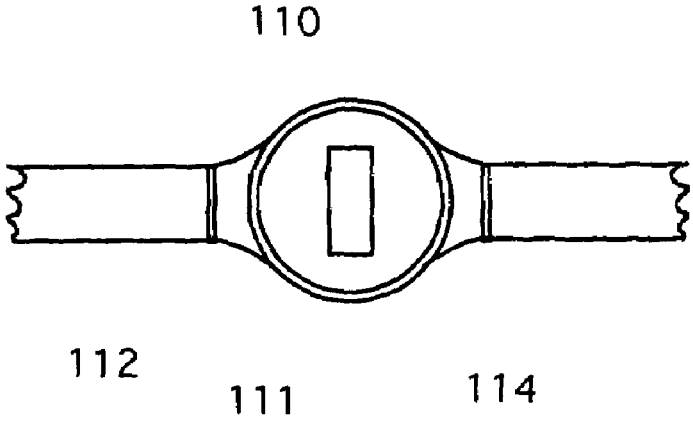
FIG. 19 is a top view of an eleventh embodiment

FIG. 19 is a top view of an eleventh embodiment. In this design, the watch 110 has a case 111 with a band 112. A turntable 113 sits in the case (see FIGS. 20-21) so that it is free to rotate. A display 114 is positioned into the turntable as shown.

Figure 20:
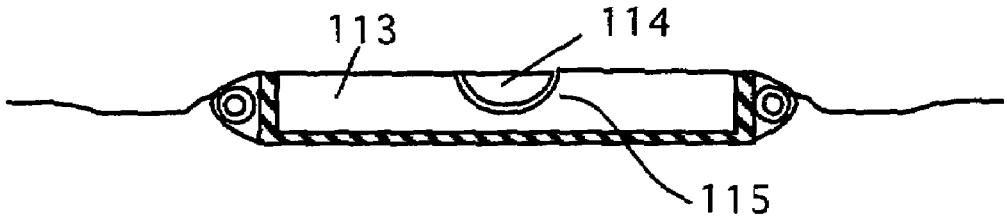
FIG. 20 is a cross-section of the eleventh embodiment showing the display in a flat configuration.

FIG. 20 is a cross-section of the eleventh embodiment. In this figure, the display 114 is shown in a cradle 115. This cradle allows the display to rotate to an elevated position (see FIG. 21). FIG. 20 shows the display in a flat position.

Figure 21:
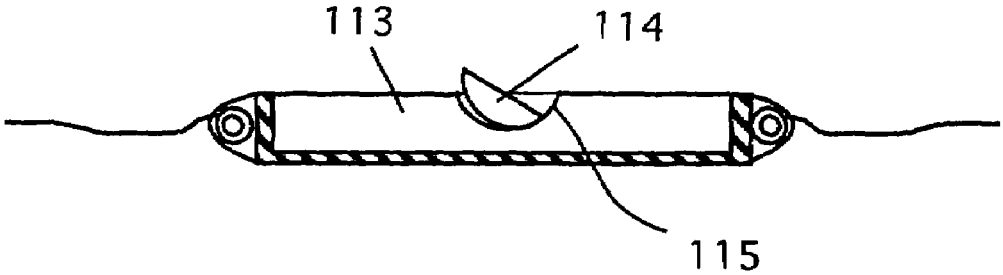
FIG. 21 is a cross-section of the eleventh embodiment showing the display in a tilted position.

FIG. 21 is a cross-section of the eleventh embodiment showing the display in a tilted or elevated position. In this way, the user can tilt the display to a comfortable angle for viewing. In the preferred embodiment, the display is held by friction within the cradle. However, a stop mechanism can be added to control the movement of the display as desired.

Figure 22:
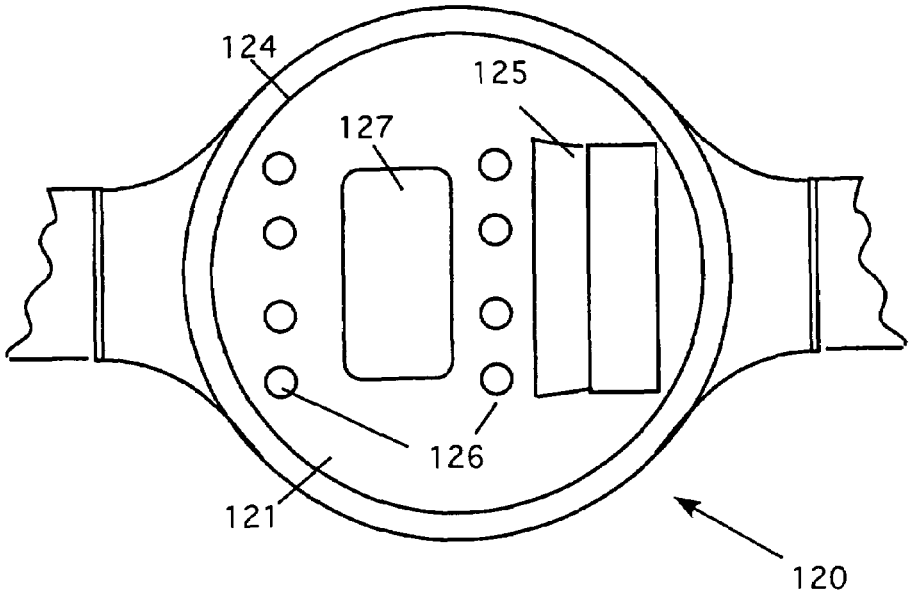
FIG. 22 is a top view of a twelfth embodiment.
Figure 23:
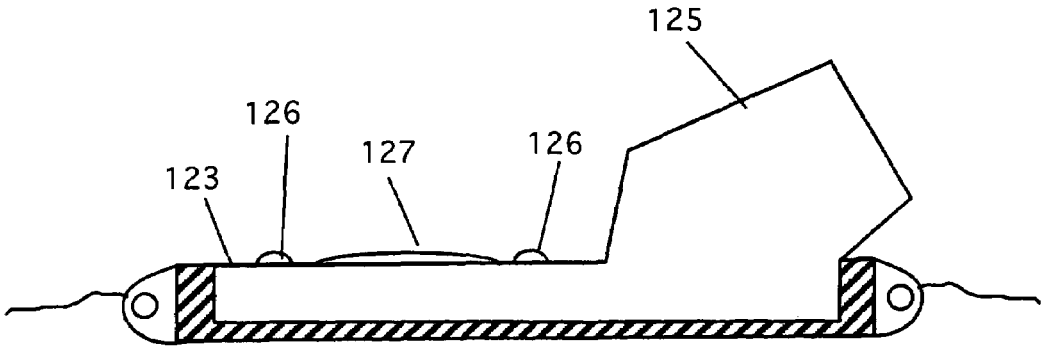
FIG. 23 is a cross-section of the twelfth embodiment.

FIGS. 22 and 23 show a twelfth embodiment. It this embodiment, the watch 120 has a case 121 with a band 122. A turntable 123 sits in the case as shown. The face 124 of the watch has a shaped display 125 that extends upward from the face. It is angled as shown. A second display 127 can be installed in the face as an option. Control buttons 126 can be placed on the face as shown to control the placement of the display or for other functions as desired. In this embodiment, the user can rotate the turntable to reposition the display as desired. Because the primary display is tilted, it can be viewed when the user's wrist is in a number of different positions.

Figure 24:
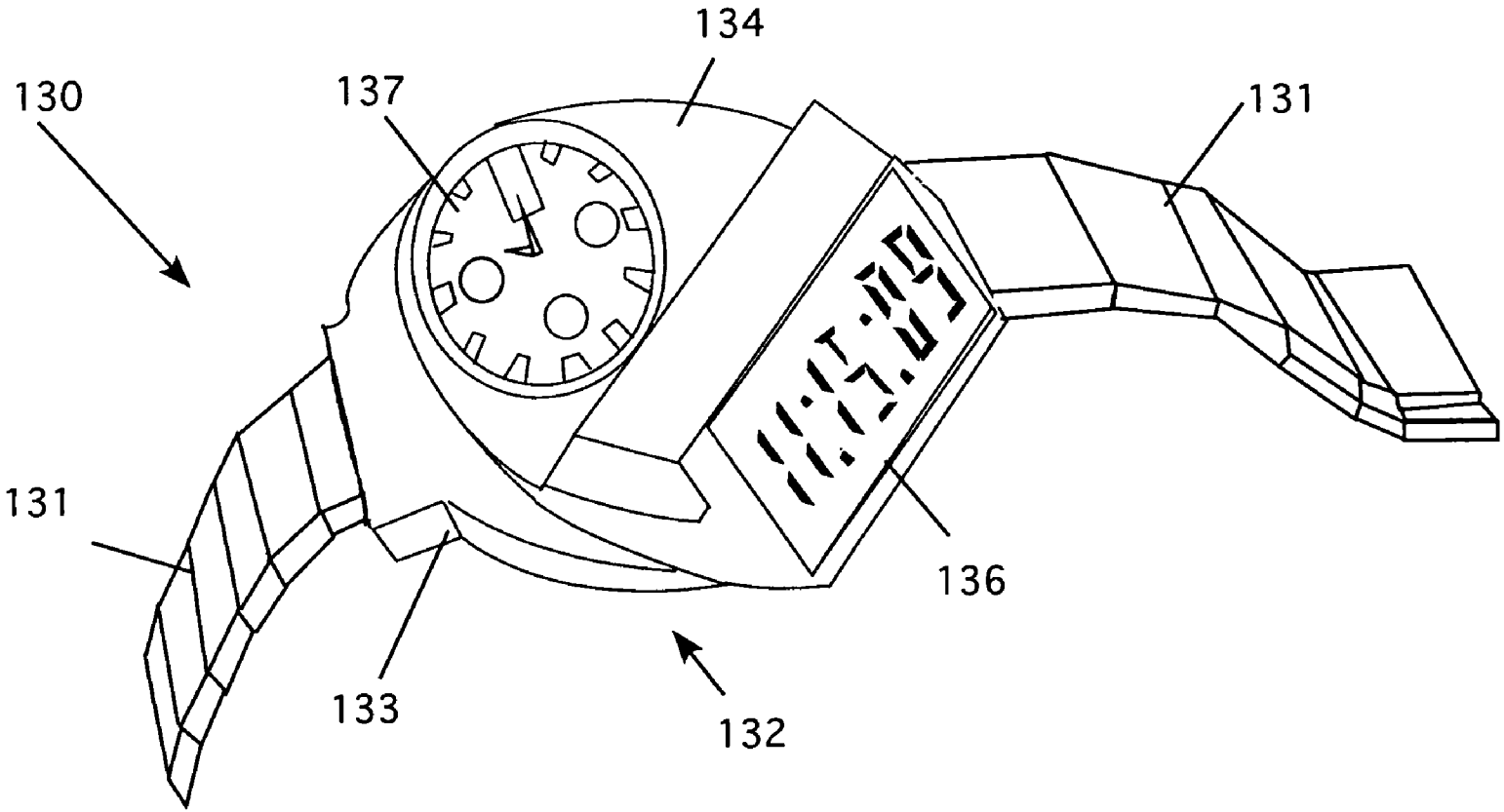
FIG. 24 is a top perspective view of a thirteenth embodiment.
Figure 25:
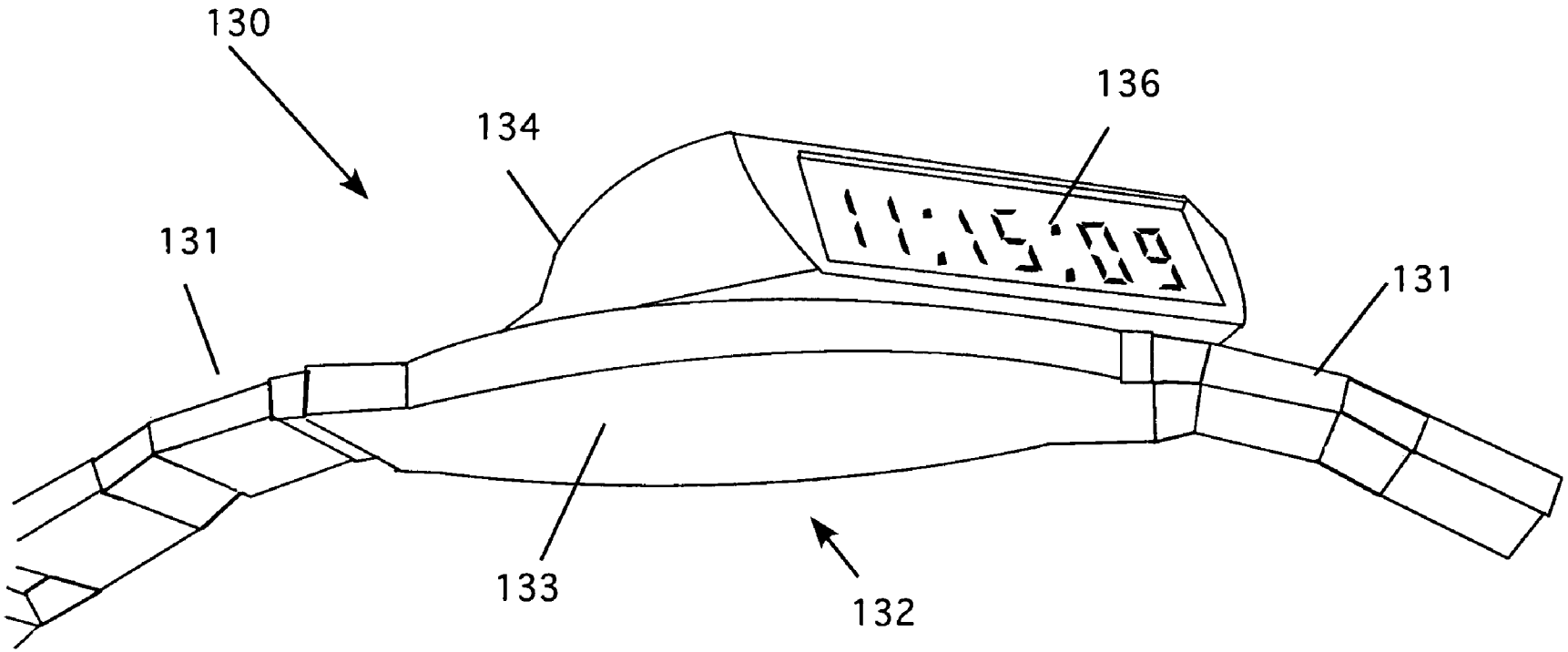
FIG. 25 is a bottom perspective view of a thirteenth embodiment.

FIGS. 24 and 25 are perspective views of a thirteenth embodiment. In this embodiment, the watch 130 has a fixed face, although the face can be designed to turn using any of the techniques described above. As shown, the watch 130 has a band 131 that attaches to a watchcase 132. The watchcase 132 has a lower section 133 and an upper section 134. As shown, the band attaches to the lower section 133, which then fits against a user's wrist. The upper section 134 has a display 135 that extends upward from the upper section as shown. In the preferred embodiment, the display 135 is a digital display. Moreover, the display has a face 136 that is angled back from vertical to allow it to be viewed easier.

The display 135 is also angled with respect to the longitudinal axis the case (i.e., with respect to a line drawn in alignment to the band). This allows the watch face to be seen when the user's arm is in a lowered position. As discussed above, the earlier embodiments disclose devices in which the angle of the face can be varied. In this embodiment, the angle is fixed. However, it has bee discovered that when the watch is rotated, the may cause discomfort to the user because the watch display makes contact with the user's wrist. This contact may cause chaffing or other discomfort. To eliminate this discomfort, the upper section 134 of the watchcase is offset from the edge of the lower section 133. This offset is clearly shown in FIG. 25. The offset allows the larger display to ride over the wrist, thereby reducing contact and increasing comfort for the user. Moreover, the offset display allows the user to view the watch when the wrist is turned because the offset allows the display to appear over the "horizon" of the user's wrist.

Note that FIG. 24 shows an optional display 137. As shown, this display is an analog watch face. This second watch face may be adjusted for the same time or can be set to indicate time in a different time zone.

Figures 26, 26A:
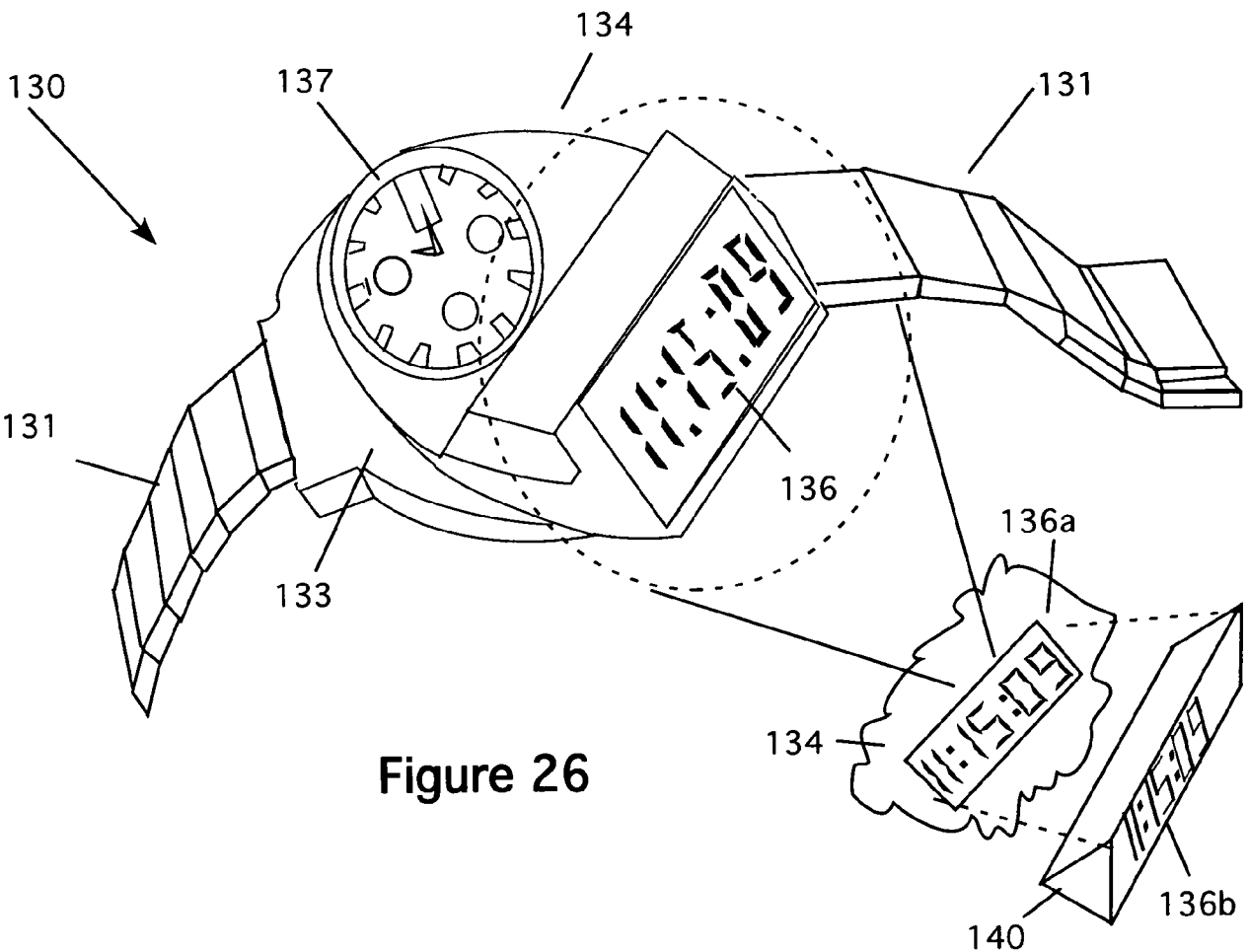
FIG. 26 is a top perspective view of a thirteenth embodiment showing an inset of FIG. 26*a*.
FIG. 26*a* is an inset showing a partially exploded view of an alternate display in which the numbers are displayed flat and then projected at an angle using a prism.

Finally, FIG. 26 shows one further modification. Instead of the digital display 136 being mounted on an angle, the display in FIG. 26 is built using a prism to project the display. Thus in FIG. 26, the display 136*a* is flat and mounted on the base of the upper section 134. A prism 140 is placed above the display in the housing, which then projects the display 136*b* at a desired angle. The display and prism are secured in the upper portion. FIG. 26 shows an inset with the prism being exploded from the upper unit to better show the structure.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A wristwatch with a movement case comprising:

a) a lower section having an outer perimeter and a center point;

b) a band, attached to said lower section;

c) an upper section, attached to said lower section;

d) a display having an outer face, attached to said upper section and extending upward therefrom, whereby the outer face of said display is positioned beyond the outer perimeter of said lower section; and e) wherein said upper section is rotatable about said center point of said lower case and also in a horizontal plane with respect to said lower section.

2. The wristwatch of claim 1 wherein the upper section is positioned at an angle of between 1 degree and 89 degrees or at an angle of between 91 degrees and one hundred seventy-nine degrees with respect to the longitudinal axis of said lower section.

3. The wristwatch of claim 1 further comprising: a second display, attached to said upper section.

4. The wristwatch of claim 1 wherein the display is a digital display.

5. The wristwatch of claim 1 wherein said display is a generally rectangular body having a face.

6. The wristwatch of claim 4 wherein the face of said generally rectangular body is angled back from a vertical.

7. The wristwatch of claim 4 wherein the digital display comprises a flat display, secured in said upper section; and a prism, placed above said flat display, whereby an image of said flat display is projected at an angle with respect to said upper portion by said prism.

8. The wristwatch of claim 3 wherein the second display is a flat display.

9. The wristwatch of claim 3 wherein the second display is aligned with the longitudinal axis of said band.

* * * * *